US010427410B2

(12) United States Patent
Nakagawa et al.

(10) Patent No.: US 10,427,410 B2
(45) Date of Patent: Oct. 1, 2019

(54) INKJET PRINTING APPARATUS AND DETECTING METHOD

(71) Applicant: CANON KABUSHIKI KAISHA, Tokyo (JP)

(72) Inventors: Yoshinori Nakagawa, Kawasaki (JP); Takatoshi Nakano, Yokohama (JP); Atsushi Takahashi, Tama (JP); Takuya Fukasawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/052,997

(22) Filed: Aug. 2, 2018

(65) Prior Publication Data

US 2019/0047290 A1 Feb. 14, 2019

(30) Foreign Application Priority Data

Aug. 10, 2017 (JP) ..... 2017-155615

(51) Int. Cl.
*B41J 2/165* (2006.01)
*B41J 2/17* (2006.01)
*B41J 29/02* (2006.01)

(52) U.S. Cl.
CPC ..... *B41J 2/16523* (2013.01); *B41J 2/16508* (2013.01); *B41J 2/16517* (2013.01); *B41J 2/16588* (2013.01); *B41J 2/1721* (2013.01); *B41J 29/02* (2013.01); *B41J 2002/1728* (2013.01)

(58) Field of Classification Search
CPC ..... B41J 2/16523; B41J 2/16508; B41J 2/16517; B41J 2/16588; B41J 2/1721; B41J 29/02
See application file for complete search history.

(56) References Cited

U.S. PATENT DOCUMENTS

| | | | | |
|---|---|---|---|---|
| 7,011,386 | B2 | 3/2006 | Iwasaki et al. | |
| 7,114,795 | B2 | 10/2006 | Shimura et al. | |
| 7,653,254 | B2 * | 1/2010 | Ito | H04N 1/32101 382/232 |
| 8,944,562 | B2 | 2/2015 | Nakagawa et al. | |
| 9,862,195 | B2 | 1/2018 | Genta et al. | |
| 2006/0113388 | A1 * | 6/2006 | Chung | B65H 7/14 235/462.18 |
| 2006/0290723 | A1 * | 12/2006 | Jeong | B41J 2/17566 347/7 |
| 2018/0079218 | A1 | 3/2018 | Genta et al. | |
| 2018/0154630 | A1 | 6/2018 | Takahashi et al. | |

FOREIGN PATENT DOCUMENTS

JP 2013056506 A 3/2013

OTHER PUBLICATIONS

U.S. Appl. No. 16/023,007, to Fukasawa et al., filed Jun. 29, 2018.

* cited by examiner

*Primary Examiner* — Lamson D Nguyen
(74) *Attorney, Agent, or Firm* — Venable LLP

(57) ABSTRACT

There is provided an inkjet printing apparatus capable of properly determining full capacity of a waste ink tank with less errors. To achieve this, full capacity of the waste ink tank is determined based on an amount of waste ink discharged after a point when a detection pin provided on an absorber in a waste ink tank detects ink and an amount of waste ink discharged over a past predetermined period of time before the point.

12 Claims, 14 Drawing Sheets

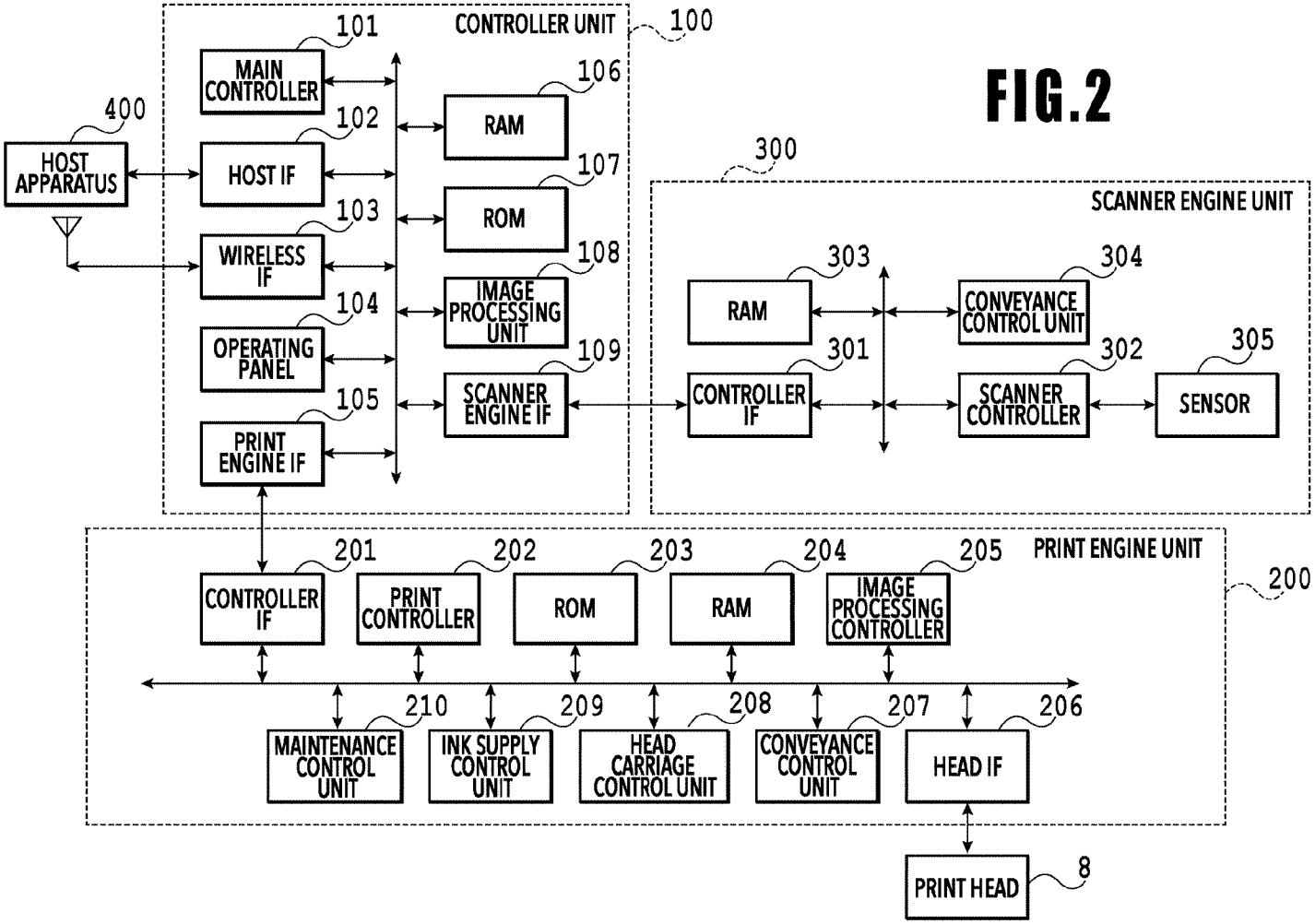
FIG.2
CONTROLLER UNIT
100
MAIN CONTROLLER
101
HOST IF
102
WIRELESS IF
103
OPERATING PANEL
104
PRINT ENGINE IF
105
RAM
106
ROM
107
IMAGE PROCESSING UNIT
108
SCANNER ENGINE IF
109
HOST APPARATUS
400
SCANNER ENGINE UNIT
300
RAM
303
CONTROLLER IF
301
CONVEYANCE CONTROL UNIT
304
SCANNER CONTROLLER
302
SENSOR
305
PRINT ENGINE UNIT
200
CONTROLLER IF
201
PRINT CONTROLLER
202
ROM
203
RAM
204
IMAGE PROCESSING CONTROLLER
205
HEAD IF
206
CONVEYANCE CONTROL UNIT
207
HEAD CARRIAGE CONTROL UNIT
208
INK SUPPLY CONTROL UNIT
209
MAINTENANCE CONTROL UNIT
210
PRINT HEAD
8

| MAINTENANCE PROCESS | AMOUNT OF DISCHARGED WASTE INK |
|---|---|
| FIRST SUCTION | 20000mg |
| SECOND SUCTION | 1000mg |
| FIRST WIPING PROCESS | 150mg |
| SECOND WIPING PROCESS | 100mg |

FIG.12A

| TIME | Cpt |
|---|---|
| 13:00 | 2050mg |
| 14:00 | 0mg |
| 15:00 | 15000mg |
| 16:00 | 600mg |

FIG.12B

| EVAPORATION AMOUNT | | HUMIDITY | | | |
|---|---|---|---|---|---|
| | | LOWER THAN 10% | EQUAL TO OR HIGHER THAN 10%, LOWER THAN 50% | EQUAL TO OR HIGHER THAN 50%, LOWER THAN 80% | EQUAL TO OR HIGHER THAN 80% |
| TEMPERATURE | LOWER THAN 15°C | 14mg | 8mg | 3mg | 2mg |
| | EQUAL TO OR HIGHER THAN 15°C, LOWER THAN 23°C | 14mg | 8mg | 3mg | 2mg |
| | EQUAL TO OR HIGHER THAN 23°C, LOWER THAN 30°C | 15mg | 8mg | 3mg | 2mg |
| | EQUAL TO OR HIGHER THAN 30°C | 15mg | 8mg | 3mg | 2mg |

FIG.14

INKJET PRINTING APPARATUS AND DETECTING METHOD

BACKGROUND OF THE INVENTION

Field of the Invention

The present invention relates to an inkjet printing apparatus for ejecting ink and printing an image and a method for detecting ink in a waste ink tank provided in the inkjet printing apparatus.

Description of the Related Art

For an inkjet printing apparatus, there is known a method for determining full capacity of a waste ink tank by providing, in the waste ink tank, a detection pin for detecting the ink, based on a detection result obtained by the detection pin and a count value of a waste ink amount. For example, Japanese Patent Laid-Open No. 2013-056506 discloses a method for determining full capacity of a waste ink tank based on a detection result obtained by a detection pin and an integrated value of waste ink discharged since the waste ink tank was installed in an apparatus.

However, a large-capacity waste ink tank installed in a relatively large inkjet printing apparatus requires a certain period of time for waste ink to become stable after discharged and diffused in an absorber. Accordingly, at a point when the detection pin detects the ink, the waste ink accommodated before the detection may still be in the course of diffusion in the absorber. For this reason, even if counting of a waste ink amount is started after the detection by the detection pin, the count value does not include a waste ink amount during diffusion, and thus the waste ink in an amount exceeding the amount of waste ink absorbable by the absorber may be discharged to the waste ink tank.

In Japanese Patent Laid-Open No. 2013-056506, although a total amount (integrated value) of the waste ink discharged to the waste ink tank before the detection by the detection pin is managed, a point when the waste ink is discharged is not managed. Therefore, even in Japanese Patent Laid-Open No. 2013-056506, it is impossible to grasp the waste ink amount during diffusion, and it is difficult to properly determine full capacity (whether the waste ink amount is equal to or greater than a predetermined amount) of the waste ink tank.

SUMMARY OF THE INVENTION

The present invention has been made to solve the above problems. An object of the present invention is to provide an inkjet printing apparatus capable of properly determining whether a waste ink amount in a waste ink tank is equal to or greater than a predetermined amount, with less errors.

According to a first aspect of the present invention, there is provided an inkjet printing apparatus comprising: a print head that ejects ink for printing; a maintenance unit configured to perform maintenance operation of the print head; a waste ink tank having an absorber that absorbs ink discharged by the maintenance unit; a detecting unit provided on the absorber and configured to detect ink discharged to the absorber; a first counting unit configured to count an amount of ink discharged to the waste ink tank for every first period of time; a second counting unit configured to count an amount of ink discharged to the waste ink tank after the detecting unit detects ink; and a determining unit configured to determine whether an amount of ink in the waste ink tank is equal to or greater than a predetermined amount, wherein the determining unit makes determination based on an amount of ink counted by the first counting unit over a past second period of time before a point when the detecting unit detects ink and an amount of ink counted by the second counting unit.

According to a second aspect of the present invention, there is provided a detecting method for detecting ink in a waste ink tank of an inkjet printing apparatus that includes: a print head that ejects ink for printing; a maintenance unit configured to perform maintenance operation of the print head; a waste ink tank having an absorber that absorbs ink discharged by the maintenance unit; and a detecting unit provided on the absorber and configured to detect ink discharged to the absorber, the detecting method comprising: a first counting step of counting an amount of ink discharged to the waste ink tank for every first period of time; a second counting step of counting an amount of ink discharged to the waste ink tank after the detecting unit detects ink; and a determining step of determining whether an amount of ink in the waste ink tank is equal to or greater than a predetermined amount based on an amount of ink counted in the first counting step over a past second period of time before a point when the detecting unit detects ink and an amount of ink counted in the second counting step.

Further features of the present invention will become apparent from the following description of exemplary embodiments with reference to the attached drawings.

BRIEF DESCRIPTION OF THE DRAWINGS

FIG. 2 is a control configuration diagram of the printing apparatus;

FIGS. 12A and 12B are a waste ink amount table and a table of history information, respectively;

FIG. 14 is a table of an ink evaporation amount corresponding to an ambient temperature and an ambient humidity.

DESCRIPTION OF THE EMBODIMENTS

Figure 1:
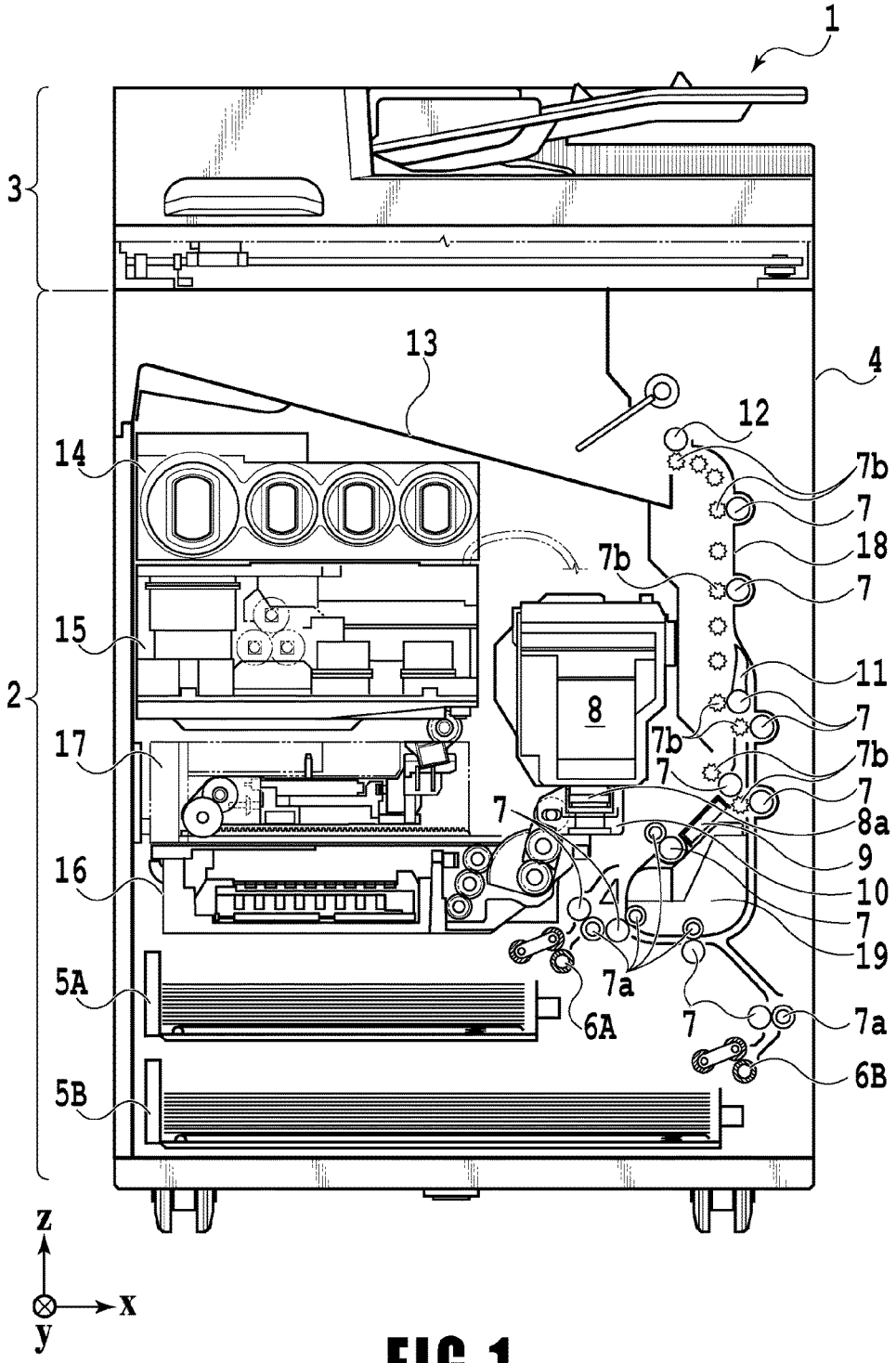
FIG. 1 is an internal configuration diagram of an inkjet printing apparatus.

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing a print medium (cut sheet) S are detachably provided at the bottom of a casing 4 in the vertical direction. A relatively small print medium of up to A4 size is placed flat and housed in the first cassette 5A and a relatively large print medium of up to A3 size is placed flat and housed in the second cassette 5B. A first feeding unit 6A for sequentially feeding a housed print medium is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the print head 8.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for placing and housing a print medium S that was subjected to print operation and discharged by the discharging roller 12.

The print head 8 of the present embodiment is a full line type color inkjet print head. In the print head 8, a plurality of ejection openings configured to eject ink based on print data are arrayed in the y-direction in FIG. 1 so as to correspond to the width of a print medium S. When the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y-direction and supports, from the back side, a print medium S subjected to print operation by the print head 8. The movement of the print head 8 from the standby position to a printing position will be described later in detail.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform a maintenance operation for the print head 8. The maintenance operation will be described later in detail.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 400, the main controller 101 transmits the command to the scanner unit 3 via a scanner engine I/F 109.

An operating panel 104 is a mechanism to allow a user to do input and output for the printing apparatus 1. A user can give an instruction to perform operation such as copying and scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. When various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform print operation based on the print data via a head I/F 206. At this time, the print controller 202 conveys a print medium S by driving the feeding units 6A and 6B, conveying rollers 7, discharging roller 12, and flapper 11 shown in FIG. 1 via a conveyance control unit 207. The print head 8 performs print operation in synchronization with the conveyance operation of the print medium S under instructions from the print controller 202, thereby performing printing.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 when performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
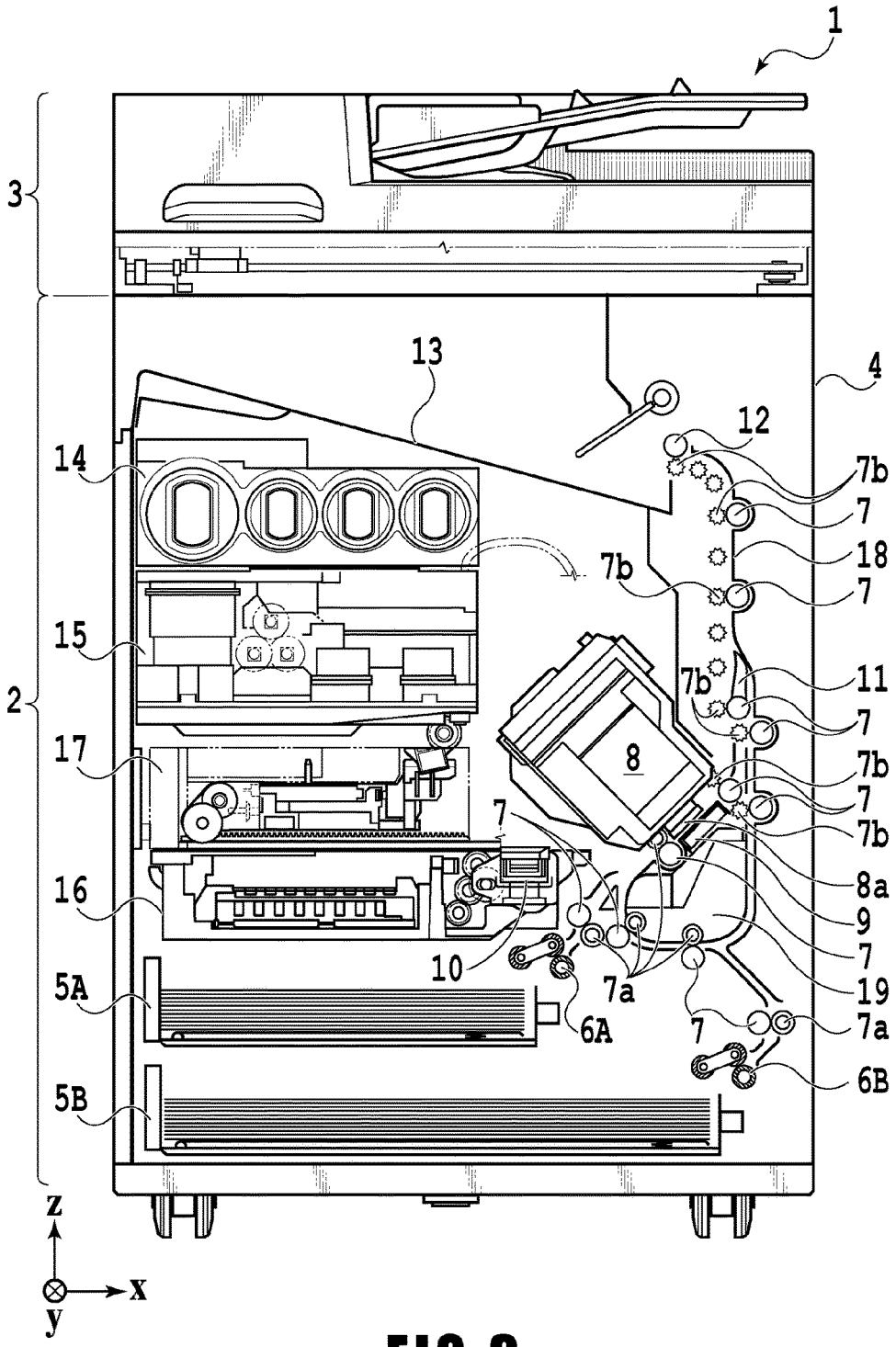
FIG. 3 is a diagram showing the printing apparatus in a printing state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member 10*a* from the ejection opening surface 8*a* of the print head 8. The print controller 202 then uses the head carriage control unit 208 to turn the print head 8 45° while adjusting the vertical height of the print head 8 such that the ejection opening surface 8*a* faces the platen 9. After the completion of print operation, the print controller 202 reverses the above procedure to move the print head 8 from the printing position to the standby position.

Next, a conveying path of a print medium S in the print unit 2 will be described. When a print command is input, the print controller 202 first uses the maintenance control unit 210 and the head carriage control unit 208 to move the print head 8 to the printing position shown in FIG. 3. The print controller 202 then uses the conveyance control unit 207 to drive either the first feeding unit 6A or the second feeding unit 6B in accordance with the print command and feed a print medium S.

Figure 4C:
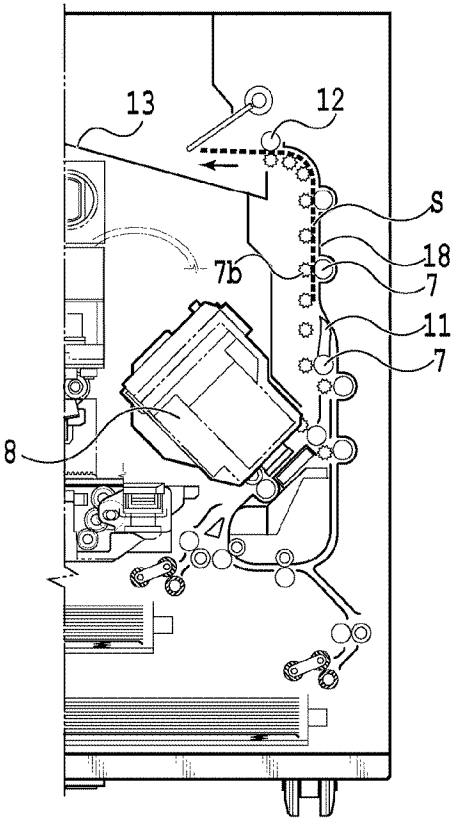
FIGS. 4A to 4C are conveying path diagrams of a print medium fed from a first cassette.
Figure 4B:
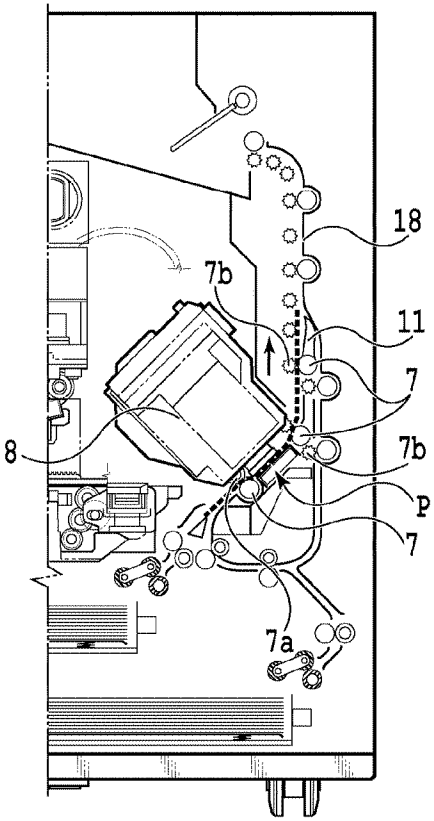
Figure 4A:
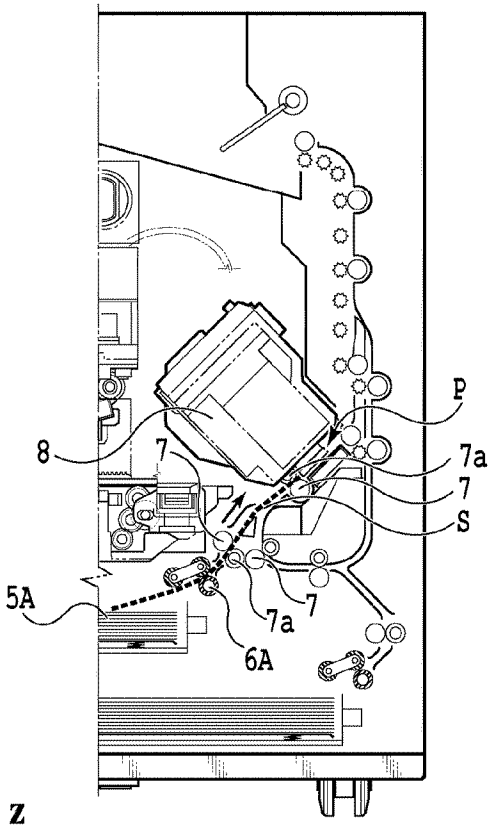

FIGS. 4A to 4C are diagrams showing a conveying path in the case of feeding an A4 size print medium S from the first cassette 5A. A print medium S at the top of a print medium stack in the first cassette 5A is separated from the rest of the stack by the first feeding unit 6A and conveyed toward a print area P between the platen 9 and the print head 8 while being nipped between the conveying rollers 7 and the pinch rollers 7*a*. FIG. 4A shows a conveying state where the front end of the print medium S is about to reach the print area P. The direction of movement of the print medium S is changed from the horizontal direction (x-direction) to a direction inclined about 45° with respect to the horizontal direction while being fed by the first feeding unit 6A to reach the print area P.

In the print area P, a plurality of ejection openings provided in the print head 8 eject ink toward the print medium S. In an area where ink is applied to the print medium S, the back side of the print medium S is supported by the platen 9 so as to keep a constant distance between the ejection opening surface 8*a* and the print medium S. After ink is applied to the print medium S, the conveying rollers 7 and the spurs 7*b* guide the print medium S such that the print medium S passes on the left of the flapper 11 with its tip inclined to the right and is conveyed along the guide 18 in the vertically upward direction of the printing apparatus 1. FIG. 4B shows a state where the front end of the print medium S has passed through the print area P and the print medium S is being conveyed vertically upward. The conveying rollers 7 and the spurs 7*b* change the direction of movement of the print medium S from the direction inclined about 45° with respect to the horizontal direction in the print area P to the vertically upward direction.

After being conveyed vertically upward, the print medium S is discharged into the discharging tray 13 by the discharging roller 12 and the spurs 7*b*. FIG. 4C shows a state where the front end of the print medium S has passed through the discharging roller 12 and the print medium S is being discharged into the discharging tray 13. The discharged print medium S is held in the discharging tray 13 with the side on which an image was printed by the print head 8 down.

Figure 5C:
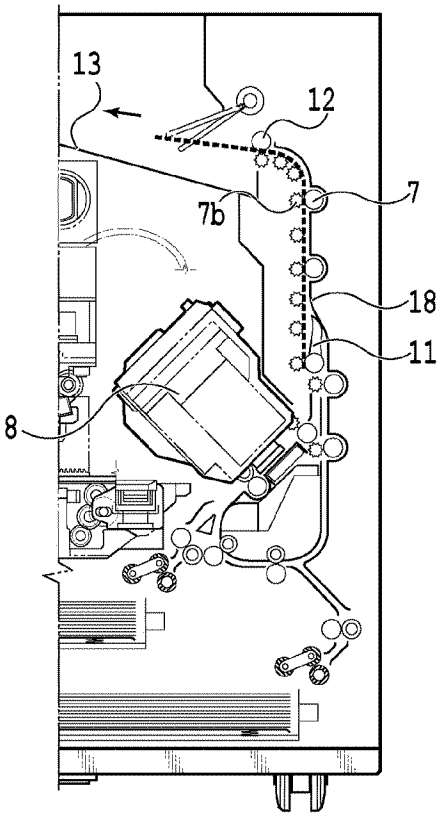
FIGS. 5A to 5C are conveying path diagrams of a print medium fed from a second cassette.
Figure 5B:
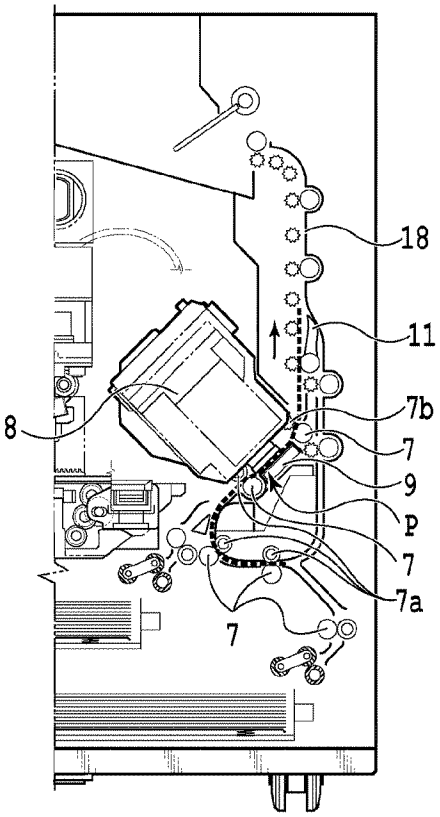
Figure 5A:
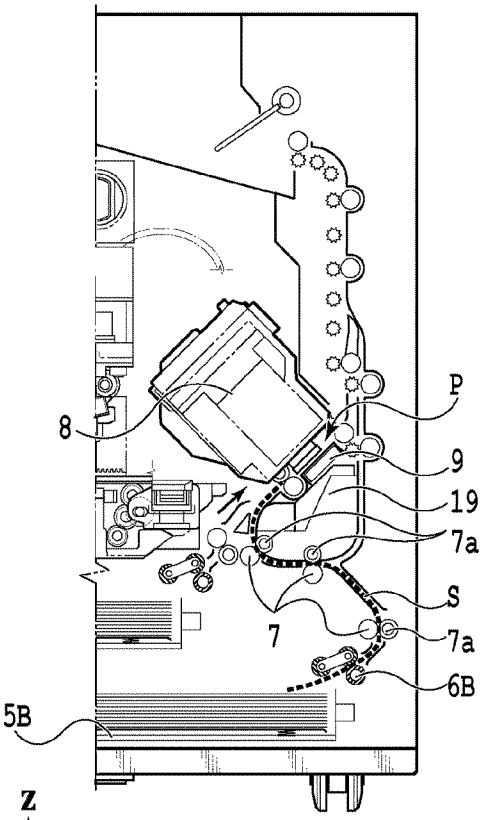

FIGS. 5A to 5C are diagrams showing a conveying path in the case of feeding an A3 size print medium S from the second cassette 5B. A print medium S at the top of a print medium stack in the second cassette 5B is separated from the rest of the stack by the second feeding unit 6B and conveyed toward the print area P between the platen 9 and the print head 8 while being nipped between the conveying rollers 7 and the pinch rollers 7*a*.

FIG. 5A shows a conveying state where the front end of the print medium S is about to reach the print area P. In a part of the conveying path, through which the print medium S is fed by the second feeding unit 6B toward the print area P, the plurality of conveying rollers 7, the plurality of pinch rollers 7*a*, and the inner guide 19 are provided such that the print medium S is conveyed to the platen 9 while being bent into an S-shape.

The rest of the conveying path is the same as that in the case of the A4 size print medium S shown in FIGS. 4B and 4C. FIG. 5B shows a state where the front end of the print medium S has passed through the print area P and the print medium S is being conveyed vertically upward. FIG. 5C shows a state where the front end of the print medium S has passed through the discharging roller 12 and the print medium S is being discharged into the discharging tray 13.

FIGS. 6A to 6D show a conveying path in the case of performing print operation (duplex printing) for the back side (second side) of an A4 size print medium S. In the case of duplex printing, print operation is first performed for the first side (front side) and then performed for the second side (back side). A conveying procedure during print operation for the first side is the same as that shown in FIGS. 4A to 4C and therefore description will be omitted. A conveying procedure subsequent to FIG. 4C will be described below.

Figures 6A, 6B, 6C, 6D:
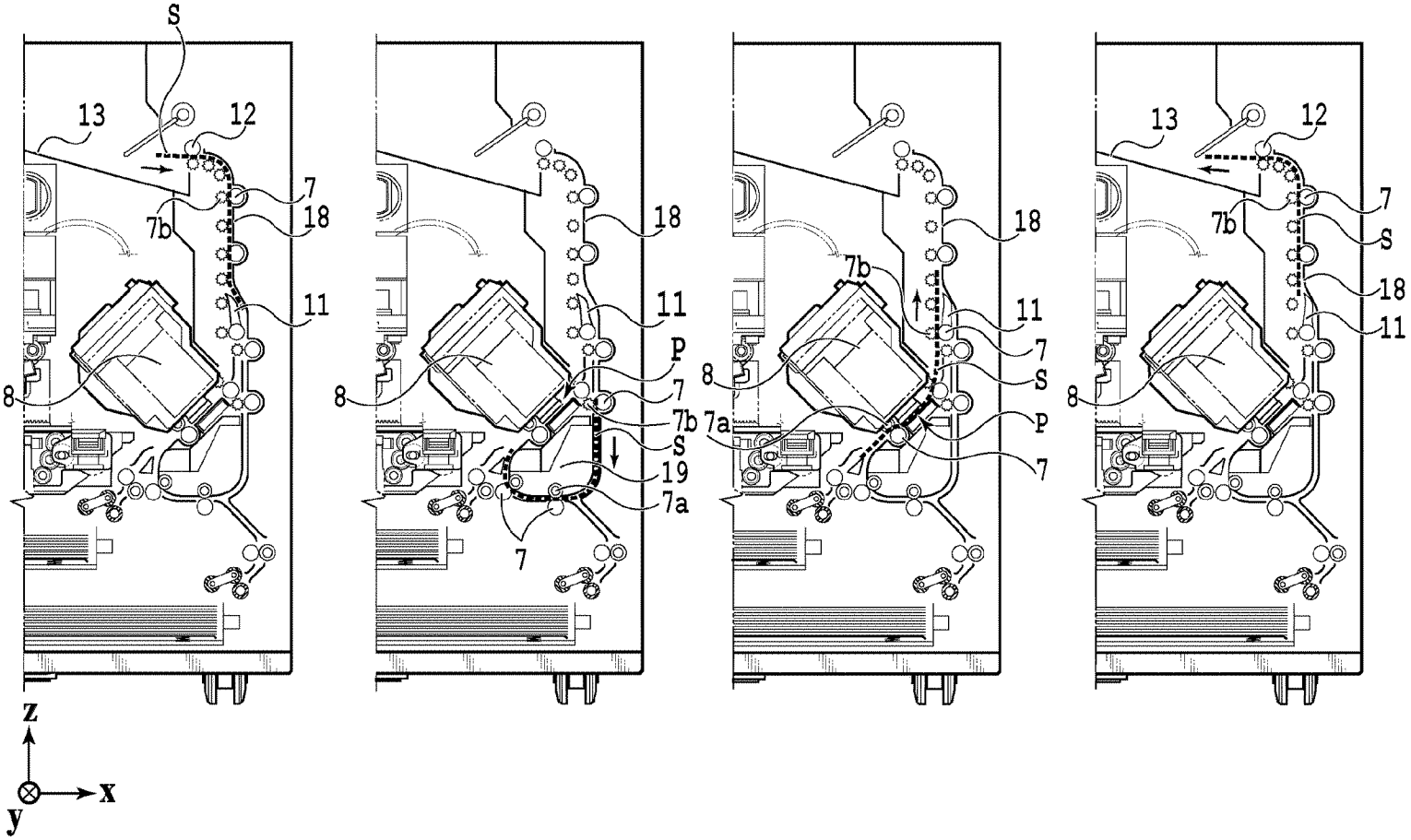
FIGS. 6A to 6D are conveying path diagrams in the case of performing print operation for the back side of a print medium.

After the print head 8 finishes print operation for the first side and the back end of the print medium S passes by the flapper 11, the print controller 202 turns the conveying rollers 7 reversely to convey the print medium S into the printing apparatus 1. At this time, since the flapper 11 is controlled by an actuator (not shown) such that the tip of the flapper 11 is inclined to the left, the front end of the print medium S (corresponding to the back end during the print operation for the first side) passes on the right of the flapper 11 and is conveyed vertically downward. FIG. 6A shows a state where the front end of the print medium S (corresponding to the back end during the print operation for the first side) is passing on the right of the flapper 11.

Then, the print medium S is conveyed along the curved outer surface of the inner guide 19 and then conveyed again to the print area P between the print head 8 and the platen 9. At this time, the second side of the print medium S faces the ejection opening surface 8*a* of the print head 8. FIG. 6B shows a conveying state where the front end of the print medium S is about to reach the print area P for print operation for the second side.

The rest of the conveying path is the same as that in the case of the print operation for the first side shown in FIGS. 4B and 4C. FIG. 6C shows a state where the front end of the print medium S has passed through the print area P and the print medium S is being conveyed vertically upward. At this time, the flapper 11 is controlled by the actuator (not shown) such that the tip of the flapper 11 is inclined to the right. FIG. 6D shows a state where the front end of the print medium S has passed through the discharging roller 12 and the print medium S is being discharged into the discharging tray 13.

Next, maintenance operation for the print head 8 will be described. As described with reference to FIG. 1, the maintenance unit 16 of the present embodiment comprises the cap unit 10, the wiping unit 17, a waste ink tank 20, and the like and activates them at predetermined timings to perform maintenance operation.

Figure 7:
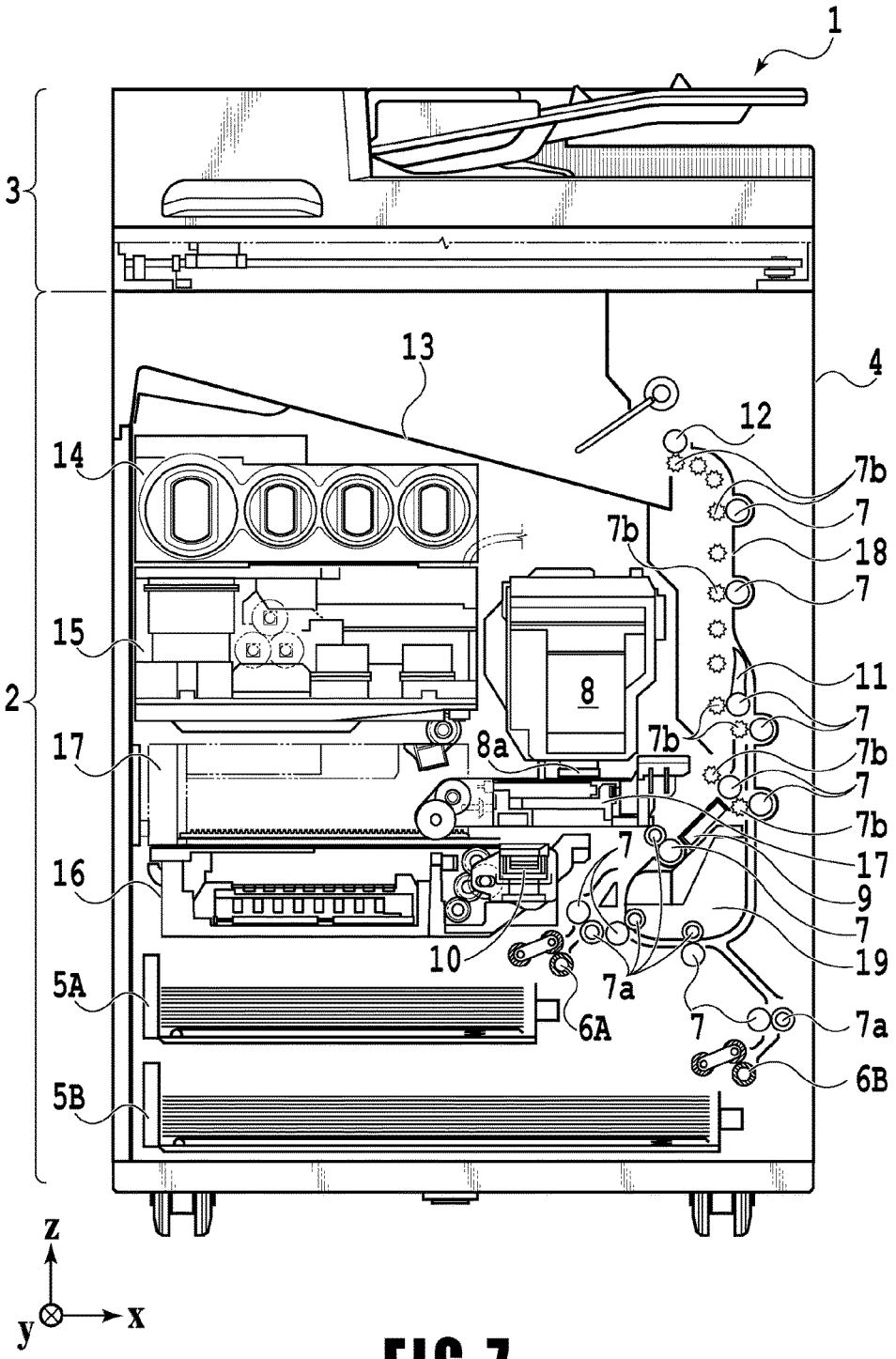
FIG. 7 is a diagram showing the printing apparatus in a maintenance state.

FIG. 7 is a diagram showing the printing apparatus 1 in a maintenance state. In the case of moving the print head 8 from the standby position shown in FIG. 1 to a maintenance position shown in FIG. 7, the print controller 202 moves the print head 8 vertically upward and moves the cap unit 10 vertically downward. The print controller 202 then moves the wiping unit 17 from the evacuation position to the right in FIG. 7. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 7, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed by the maintenance unit 16.

Figure 8A:
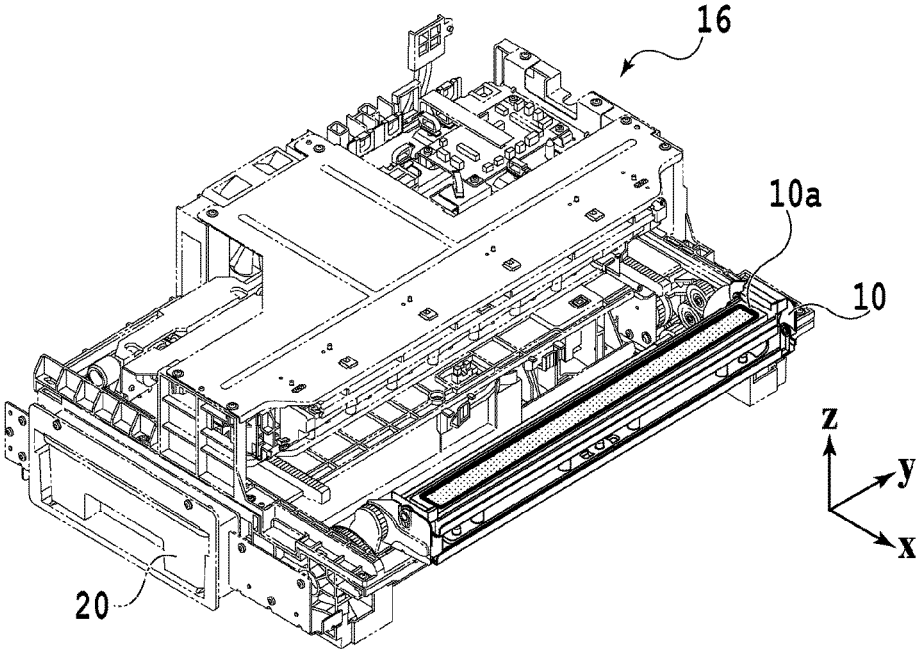
FIGS. 8A and 8B are perspective views showing the configuration of a maintenance unit.
Figure 8B:
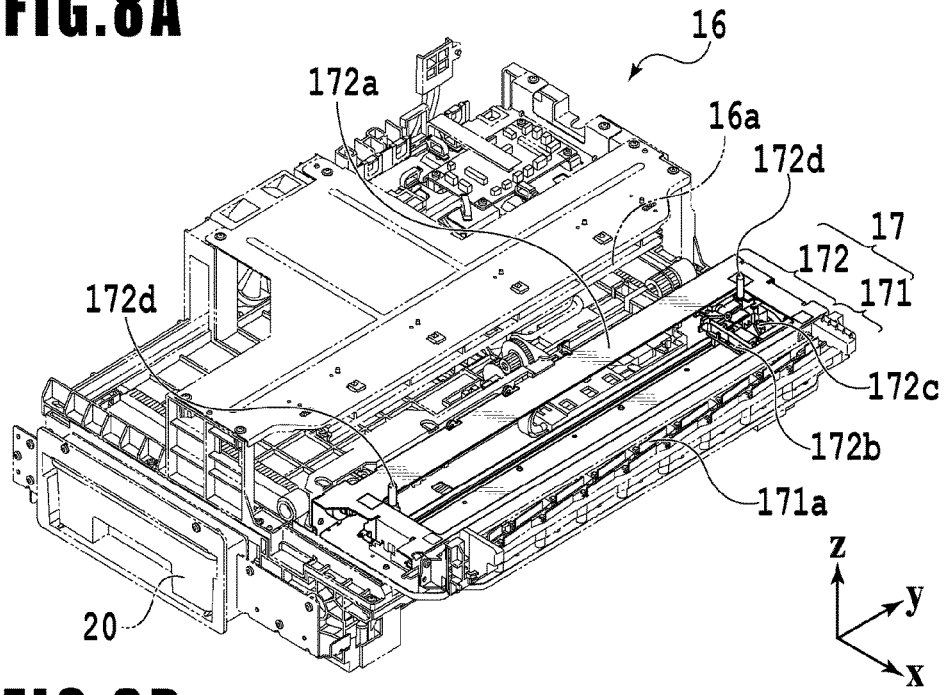

FIG. 8A is a perspective view showing the maintenance unit 16 in a standby position. FIG. 8B is a perspective view showing the maintenance unit 16 in a maintenance position. FIG. 8A corresponds to FIG. 1 and FIG. 8B corresponds to FIG. 7. When the print head 8 is in the standby position, the maintenance unit 16 is in the standby position shown in FIG. 8A, the cap unit 10 has been moved vertically upward, and the wiping unit 17 is housed in the maintenance unit 16. The cap unit 10 comprises a box-shaped cap member 10*a* extending in the y-direction. The cap member 10*a* covers the ejection opening surface 8*a* of the print head 8 to prevent ink from evaporating from the ejection openings. The cap unit 10 also has the function of collecting ink ejected to the cap member 10*a* for preliminary ejection or the like and allowing a suction pump (not shown) to suck the collected ink. Furthermore, the cap unit 10 also has the function of sucking and forcibly discharging ink from the ejection openings by using a suction pump (not shown) in a state where the cap member 10*a* covers the ejection opening surface 8*a* of the print head 8.

On the other hand, in the maintenance position shown in FIG. 8B, the cap unit 10 has been moved vertically downward and the wiping unit 17 has been drawn from the maintenance unit 16. The wiping unit 17 comprises two wiper units: a blade wiper unit 171 and a vacuum wiper unit 172.

In the blade wiper unit 171, blade wipers 171*a* for wiping the ejection opening surface 8*a* in the x-direction are provided in the y-direction by the length of an area where the ejection openings are arrayed. In the case of performing wiping operation by the use of the blade wiper unit 171, the wiping unit 17 moves the blade wiper unit 171 in the x-direction while the print head 8 is positioned at a height at which the print head 8 can be in contact with the blade wipers 171*a*. This movement enables the blade wipers 171*a* to wipe ink and the like adhering to the ejection opening surface 8*a*.

The entrance of the maintenance unit 16 through which the blade wipers 171*a* are housed is equipped with a wet wiper cleaner 16*a* for removing ink adhering to the blade wipers 171*a* and applying a wetting liquid to the blade wipers 171*a*. The wet wiper cleaner 16*a* removes substances adhering to the blade wipers 171*a* and applies the wetting liquid to the blade wipers 171*a* each time the blade wipers 171*a* are inserted into the maintenance unit 16. The wetting liquid is transferred to the ejection opening surface 8*a* in the next wiping operation for the ejection opening surface 8*a*, thereby facilitating sliding between the ejection opening surface 8*a* and the blade wipers 171*a*.

The vacuum wiper unit 172 comprises a flat plate 172*a* having an opening extending in the y-direction, a carriage 172*b* movable in the y-direction within the opening, and a vacuum wiper 172*c* mounted on the carriage 172*b*. The vacuum wiper 172*c* is provided to wipe the ejection opening surface 8*a* in the y-direction along with the movement of the carriage 172*b*. The tip of the vacuum wiper 172*c* has a suction opening connected to the suction pump (not shown). Accordingly, if the carriage 172*b* is moved in the y-direction while operating the suction pump, ink and the like adhering to the ejection opening surface 8*a* of the print head 8 are wiped and gathered by the vacuum wiper 172*c* and sucked into the suction opening. At this time, the flat plate 172*a* and a dowel pin 172*d* provided at both ends of the opening are used to align the ejection opening surface 8*a* with the vacuum wiper 172*c*.

In the present embodiment, it is possible to carry out a first wiping process in which the blade wiper unit 171 performs wiping operation and the vacuum wiper unit 172 does not perform wiping operation and a second wiping process in which both the wiper units sequentially perform wiping operation. In the case of the first wiping process, the print controller 202 first draws the wiping unit 17 from the maintenance unit 16 while the print head 8 is evacuated vertically above the maintenance position shown in FIG. 7. The print controller 202 moves the print head 8 vertically downward to a position where the print head 8 can be in contact with the blade wipers 171*a* and then moves the wiping unit 17 into the maintenance unit 16. This movement enables the blade wipers 171*a* to wipe ink and the like adhering to the ejection opening surface 8*a*. That is, the blade wipers 171*a* wipe the ejection opening surface 8*a* when moving from a position drawn from the maintenance unit 16 into the maintenance unit 16.

After the blade wiper unit 171 is housed, the print controller 202 moves the cap unit 10 vertically upward, and the cap member 10*a* covers the ejection opening surface 8*a* of the print head 8. In this state, the print controller 202 drives the print head 8 to perform preliminary ejection and allows the suction pump to suck ink collected in the cap member 10*a*.

In the case of the second wiping process, the print controller 202 first slides the wiping unit 17 to draw it from the maintenance unit 16 while the print head 8 is evacuated vertically above the maintenance position shown in FIG. 7. The print controller 202 moves the print head 8 vertically downward to the position where the print head 8 can be in contact with the blade wipers 171*a* and then moves the wiping unit 17 into the maintenance unit 16. This movement enables the blade wipers 171*a* to perform wiping operation for the ejection opening surface 8*a*. Next, the print controller 202 slides the wiping unit 17 to draw it from the maintenance unit 16 to a predetermined position while the print head 8 is evacuated again vertically above the maintenance position shown in FIG. 7. Then, the print controller 202 uses the flat plate 172*a* and the dowel pins 172*d* to align the ejection opening surface 8*a* with the vacuum wiper unit 172 while moving the print head 8 down to a wiping position shown in FIG. 7. After that, the print controller 202 allows the vacuum wiper unit 172 to perform the wiping operation described above. After evacuating the print head 8 vertically upward and housing the wiping unit 17, the print controller 202 allows the cap unit 10 to perform preliminary ejection into the cap member and suction operation of collected ink in the same manner as the first wiping process.

Furthermore, in addition to the above wiping processes, the maintenance unit 16 also performs a suction process for sucking and forcibly discharging ink from ejection openings by using a suction pump (not shown) in a state where the cap member 10*a* covers the ejection opening surface 8*a* of the print head 8. For the suction process, there are prepared a first suction process for forcibly discharging ink in a relatively large amount and a second suction process for discharging ink in a relatively small amount. Through the first suction process, the second suction process, and the suction process of ink preliminarily ejected to the inside of the cap member 10*a*, the ink sucked by the suction pump (not shown) is accommodated in the waste ink tank 20 placed inside the maintenance unit 16. The waste ink tank 20 is installed by being inserted in the y-direction from the front of the inkjet printing apparatus 1. That is, a user can remove the waste ink tank 20 that has reached full capacity (a waste ink amount is equal to or greater than a predetermined amount) from the apparatus body and replace it with a new waste ink tank 20.

Figure 9A:
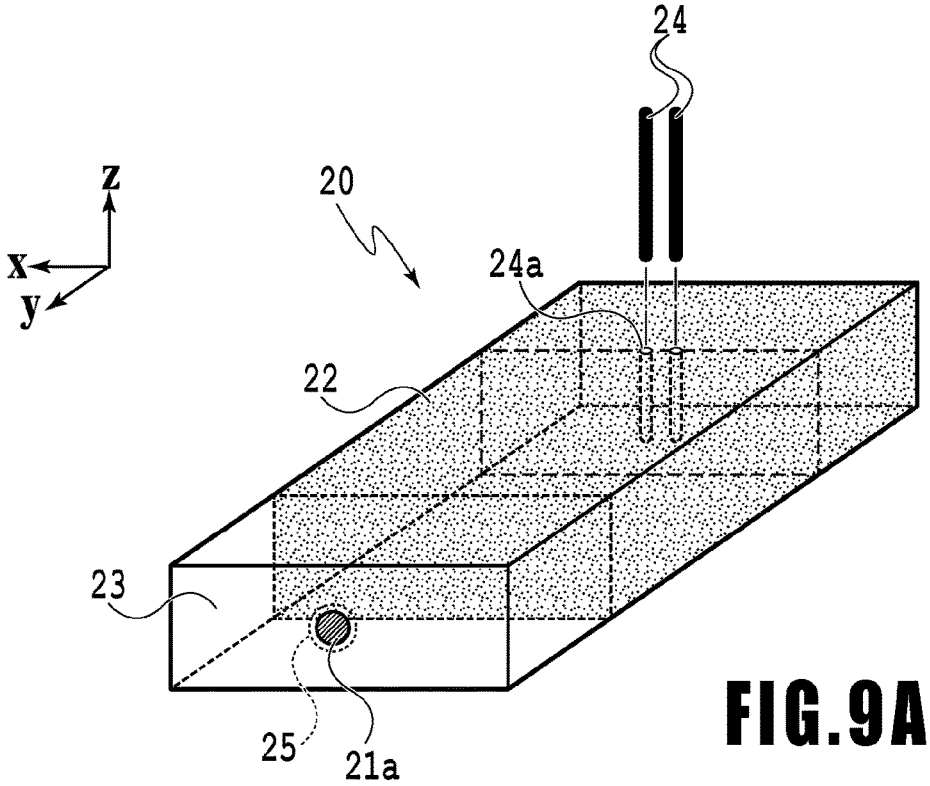
FIGS. 9A and 9B are perspective diagrams of an appearance of a waste ink tank 20.
Figure 9B:
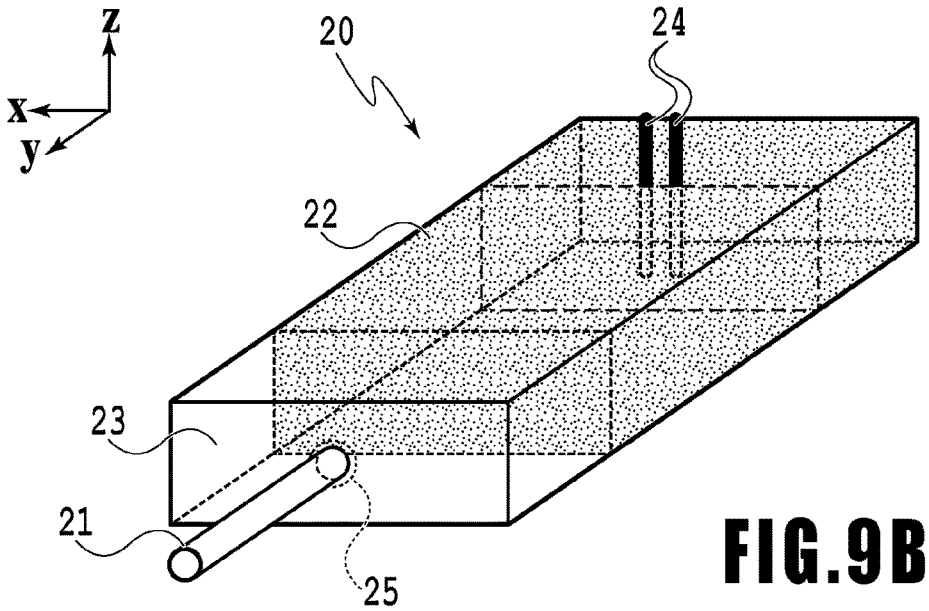

FIGS. 9A and 9B are perspective diagrams of the waste ink tank 20. FIG. 9A and FIG. 9B respectively show the waste ink tank 20 before installation in the body and the waste ink tank 20 after installation in the body. As shown in FIG. 9A, on a surface of the waste ink tank 20 in the y-direction (on a surface on the back side at the time of installation in the apparatus body), an opening 21*a* for connection to a discharge joint 21 provided on the apparatus and an atmosphere communication port 25 surrounding the opening are formed. Furthermore, in a position slightly displaced in the +y-direction from a back surface of the waste ink tank 20 in the y-direction (a surface on the front side at the time of installation in the apparatus body), a receiving opening 24*a* for receiving a detection pin 24 provided on the apparatus is formed. This waste ink tank 20 is inserted in the +y-direction and installed in the apparatus, whereby the opening 21*a* is coupled to the discharge joint 21 and the detection pin 24 is inserted into the receiving opening 24*a* as shown in FIG. 9B. It should be noted that the detection pin (detecting unit) 24 is made up of two electrodes having different polarities, and electrical conduction can be confirmed via ink between the electrodes.

Inside the waste ink tank 20, which is substantially a rectangular parallelepiped, an area on the −y-direction side filled with the absorber 22 and a dropping space 23 on the discharge joint 21 side (the +y-direction side) are formed. Retaining ink in the absorber 22 prevents ink leakage even in a case where the waste ink tank is replaced or the apparatus tilts. In the present embodiment, a sufficient contact area between the dropping space 23 and the absorber 22 is secured so that a stable absorption force is produced even if the absorber 22 is partly clogged.

The discharge joint 21 is connected to a tube (not shown) for leading the waste ink collected by the maintenance unit 16. The waste ink discharged through the first suction process, the second suction process, the first wiping process, the second wiping process, and the like performed by the maintenance unit 16 is discharged to the dropping space 23 in the waste ink tank 20 through the discharge joint 21 via the tube (not shown).

The dropped waste ink is first accumulated in a lower part of the dropping space 23 but then gradually permeated in a depth direction of the waste ink tank 20 by capillary force of the absorber 22. If a permeation area of the absorber 22 reaches the detection pin 24 provided on a part of the absorber, electric current passes through the two electrodes and the maintenance control unit 210 detects that the waste ink has reached the position of the detection pin 24.

Figure 10A:
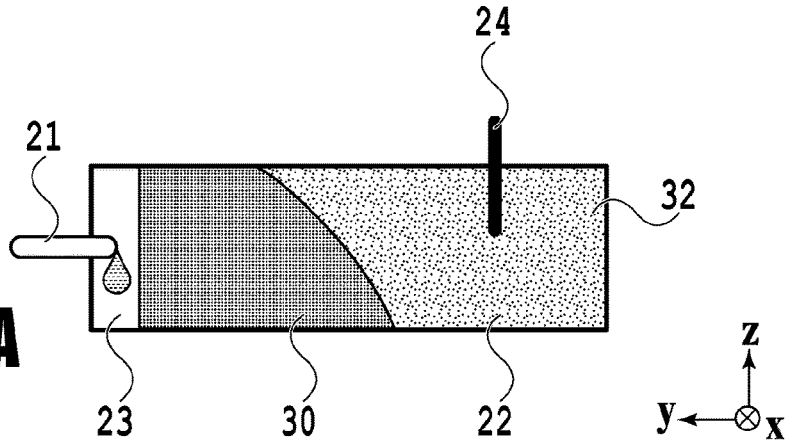
FIGS. 10A to 10C are diagrams illustrating a permeation state of waste ink that changes over time.
Figure 10B:
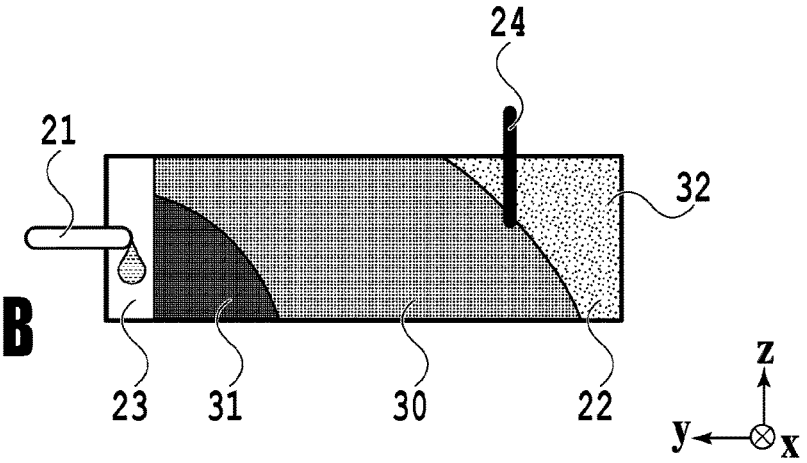
Figure 10C:
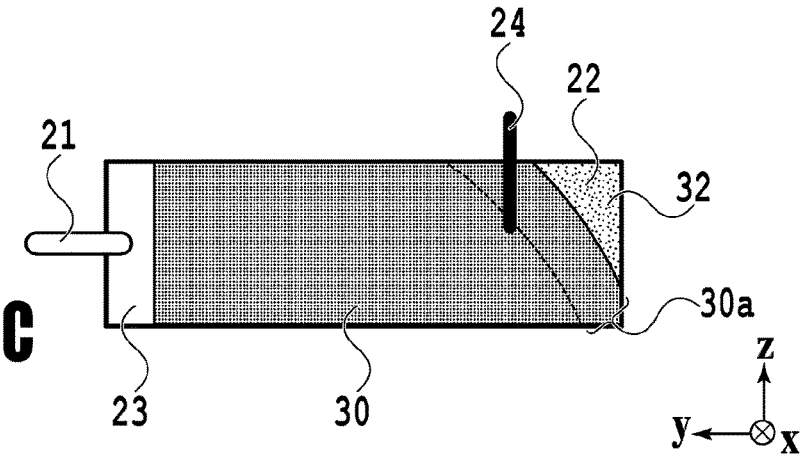

FIGS. 10A to 10C are diagrams illustrating a permeation state of the waste ink that changes over time. Ink dropped into the dropping space 23 is gradually permeating through the absorber 22 from the lower left end of the absorber 22 and becomes stable. FIG. 10A shows the absorber 22 after a lapse of a sufficient time from a maintenance process performed earlier and in a state where absorption and permeation of the waste ink discharged in the maintenance process have stopped. Hereinafter, this state is referred to as a permeation stop state. The area of the absorber 22 in the permeation stop state can be divided into an absorption area 30 where ink has already been absorbed and an unabsorbed area 32 where ink has not been absorbed yet.

When the waste ink is further discharged in a new maintenance process in the permeation stop state shown in FIG. 10A, newly added waste ink permeates into the unabsorbed area 32 through the absorption area 30. FIG. 10B shows such a permeation proceeding state. In the permeation proceeding state, the area of the absorber 22 can be divided into a saturated area 31 temporarily including ink in an amount greater than an amount that can be absorbed in the end, the absorption area 30 including ink in an amount that can be absorbed in the end, and the unabsorbed area 32 not including ink. After the permeating ink reaches the detection pin 24 in the course of the permeation proceeding state (FIG. 10B), electric current passes through the two electrodes forming the detection pin 24, and the maintenance control unit 210 can recognize that the ink has reached the detection pin 24.

Then, the permeation proceeds with a lapse of a sufficient time after a new maintenance process and when the ink in the saturated area 31 is entirely diffused, the inside of the absorber 22 becomes a permeation stop state again. FIG. 10C shows a permeation stop state after conduction in the detection pin is confirmed at the stage of FIG. 10B and also the ink discharged in the new maintenance process is diffused. As compared to FIG. 10B, a volume (capacity) of the absorption area 30 is greater and a volume (capacity) of the unabsorbed area 32 is smaller by an additional absorption area 30*a*.

The above-described permeation proceeding state and permeation stop state are repeated every time a maintenance process is performed since the waste ink tank 20 was installed in the inkjet printing apparatus 1. Further, an amount of ink discharged in the maintenance process can be stored in advance for each type of maintenance process. Accordingly, counting an amount of ink discharged in the maintenance process after conduction in the detection pin 24 is confirmed allows management of the volume (capacity) of the remaining unabsorbed area 32 and prediction of full capacity of the waste ink tank.

However, with the printing apparatus 1 of the present embodiment having a configuration of using a full line type print head and a relatively large-capacity waste ink tank 20, a relatively long time is required for the waste ink tank 20 to reach a permeation stop state after the maintenance process is performed. That is, the point when the detection pin 24 detects the ink is often in a permeation proceeding state, and if a subsequent maintenance process is permitted based on the volume (capacity) of the unabsorbed area 32 at that point, a waste ink amount may exceed an amount of ink absorbable by the ink absorber.

Therefore, the inventors of the present invention first confirmed a time required to reach a permeation stop state after the start of the maintenance process. In the case of the inkjet printing apparatus of the present embodiment, the time required was about two hours. Then, full capacity of the waste ink tank was determined based on both of an amount of ink discharged in the maintenance process performed after a point when the detection pin 24 detected conduction and an amount of ink discharged in the maintenance process performed over a past period of time corresponding to the time required before the point when the detection pin 24 detected conduction.

More specifically, there are performed a near full count for counting an amount of ink discharged in the maintenance process performed after the detection pin 24 detects conduction and a part time count for counting at predetermined time periods an amount of ink discharged in the maintenance process and storing the amount in association with a time. Based on the result of both counts, full capacity of the waste ink tank 20 is determined.

Figure 11:
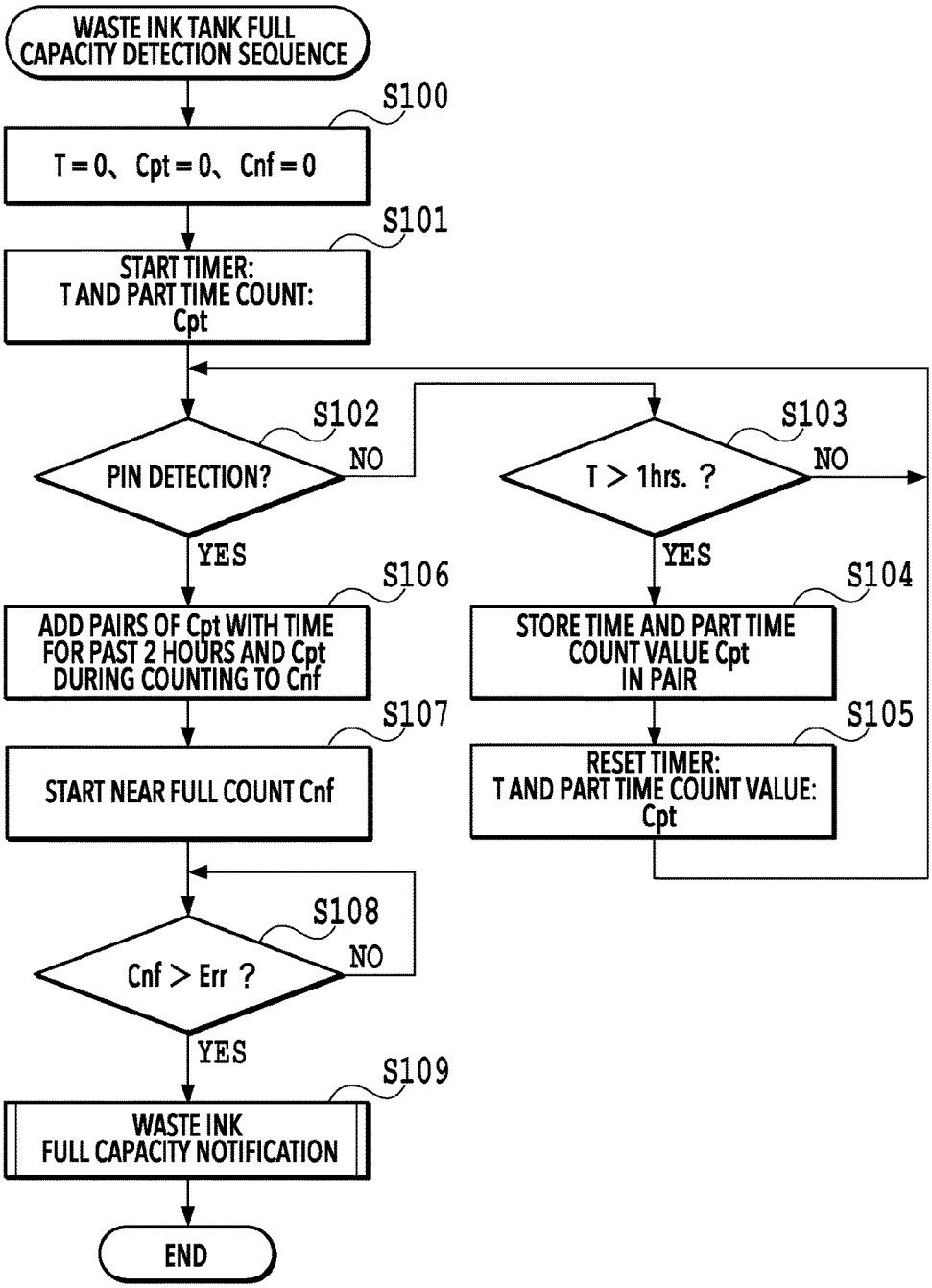
FIG. 11 is a flowchart of a full capacity detection sequence according to a first embodiment.

FIG. 11 is a flowchart illustrating a full capacity detection sequence that the maintenance control unit 210 of the present embodiment performs under instructions from the controller unit 100. This process starts on arrival of the printing apparatus 1 or at the time of installation of a new waste ink tank 20 in the printing apparatus 1. After the process starts, first in step S100, the maintenance control unit 210 resets a timer T, a part time count value Cpt, and a near full count value Cnf (T=0, Cpt=0, Cnf=0). Then, in the next step S101, the controller unit 100 starts the timer T and starts the part time count.

FIGS. 12A and 12B are a waste ink amount table and a table of history information stored in a memory, respectively, which are referenced by the maintenance control unit 210 for the part time count. As described above, the maintenance process includes various processes such as the first suction process for sucking ink in a relatively large amount, the second suction process for sucking ink in a relatively small amount, the first wiping process, and the second wiping process. Amounts of discharged ink vary depending on the processes. In the waste ink amount table shown in FIG. 12A, discharged waste ink amounts are stored in advance in association with the types of maintenance processes. Every time the maintenance process is performed, the maintenance control unit 210 refers to the table shown in FIG. 12A and adds a corresponding waste ink amount to the part time count value Cpt.

For example, it is assumed that the second suction process, the first wiping process, and the second wiping process are performed in this order after the part time count is started and by the time the count value Cpt is reset. In this case, at the point when the second wiping process is finished, the count value Cpt is represented by Cpt=1,000 mg+150 mg+100 mg=1,250 mg.

Referring back to FIG. 11, in step S102, the maintenance control unit 210 determines whether conduction in the detection pin 24 is confirmed. In a case where conduction is not confirmed, the waste ink has not reached the position of the detection pin 24 yet, and thus the process in the maintenance control unit 210 proceeds to step S103.

In step S103, the maintenance control unit 210 determines whether a count value T of the timer exceeds one hour (1 hr). In a case where the count value T does not exceed one hour, the process goes back to step S102 and the maintenance control unit 210 continues the part time count and confirmation of pin detection.

In a case where the count value T is determined to exceed one hour in step S103, the process proceeds to step S104 and the maintenance control unit 210 stores, together with a present time, the present part time count value Cpt as a waste ink amount corresponding to the present time in the memory. That is, the maintenance control unit 210 continues to count the part time count value Cpt until the count value T is determined to exceed one hour in step S103 and, for every lapse of one hour, stores the count value Cpt in association with a time.

FIG. 12B shows an example of history information stored in the memory. Together with a time, the part time count value Cpt, i.e., an amount of ink discharged in the waste ink tank, at times is stored. In the present embodiment, the memory for storing the time and the part time count value Cpt is prepared for four hours (four pairs). Every time a new part time count value Cpt is obtained, the maintenance control unit 210 overwrites and updates the history information of four hours ago.

Referring back to FIG. 11, after the history information is updated in step S104, the process proceeds to step S105 and the maintenance control unit 210 resets the timer T and the part time count value Cpt.

Meanwhile, in a case where conduction in the detection pin 24 is confirmed in step S102, the process in the maintenance control unit 210 proceeds to step S106. Then, the maintenance control unit 210 refers to the present history information stored in the memory, obtains the part time count values Cpt for the last two hours, and adds the values Cpt to the near full count value Cnf.

Now, it is assumed that, for example, in a situation in which the history information shown in FIG. 12B is stored in the memory, the detection pin 24 detects the ink at a time of 16:10. In this case, the maintenance control unit 210 calculates the near full count value Cnf based on the part time count value Cpt at a time of 15:00 and the part time count value Cpt at a time of 16:00. More specifically, in the case of FIG. 12B, the near full count value Cnf is represented by Cnf=15,000 mg+600 mg=15,600 mg. Then, the process proceeds to step S107 and the maintenance control unit 210 starts the near full count.

Also in the near full count performed in step S107 and the following steps, the maintenance control unit 210 refers to the waste ink amount table shown in FIG. 12A. Every time a maintenance process is performed, a waste ink amount obtained from the waste ink amount table is added to the near full count value Cnf.

In step S108, the maintenance control unit 210 determines whether the present near full count value Cnf exceeds a threshold Err that is set in advance. In a case where the present near full count value Cnf does not exceed the threshold Err, the near full count is continued. Meanwhile, in a case where the near full count value Cnf is determined to exceed the threshold Err, the process proceeds to step S109 and the maintenance control unit 210 performs notification of full capacity of the waste ink tank. More specifically, by an operation panel 104 of the controller unit 100, the maintenance control unit 210 notifies a user that the waste ink tank has reached full capacity and prompts the user to replace the waste ink tank 20, for example. Then, the process is finished.

It should be noted that in step S106 of the flowchart of FIG. 11, the part time count value Cpt obtained with reference to the history information is added to the near full count value Cnf. However, the present embodiment is not limited to this. In the present embodiment, the threshold Err is associated with an amount of ink that the unabsorbed area 32, which remains at the point when an end of permeation of the waste ink reaches the detection pin 24, will be able to absorb. Therefore, in step S106, which takes place before step S108 for comparing the near full count value Cnf and the threshold Err, a small difference between the near full count value Cnf and the threshold Err may be set based on a waste ink amount for which permeation is assumed to be stopped. More specifically, in step S106, the part time count value Cpt for two hours, which is assumed to be an amount of waste ink whose permeation is stopped, may be added to the near full count value Cnf or may be subtracted from the threshold Err.

As described above, according to the present embodiment, full capacity of the ink tank is determined based on both of an amount of waste ink discharged after the point when the detection pin 24 detects ink and an amount of waste ink discharged over the past predetermined period of time before the point when the detection pin 24 detects ink. At this time, the predetermined period of time refers to a time expected to be required after a predetermined maintenance process is started and by the time the permeation of ink discharged in the maintenance process is stopped. In the present embodiment, the predetermined period of time is set at two hours. That is, according to the present embodiment, full capacity of the ink tank is determined based on both of an amount of waste ink discharged after the point when the detection pin 24 detects ink and an amount of waste ink permeating at the point. Therefore, it is possible to more precisely detect a point when the waste ink tank reaches full capacity as compared to the conventional technique.

Second Embodiment

In the waste ink tank 20, evaporation of accommodated ink (evaporation of water content in ink) also proceeds through the atmosphere communication port 25, and a total amount of waste ink absorbable by the absorber is more or less affected by an evaporation amount of waste ink. In a case where the waste ink is gradually absorbed over an extended period of time, a total amount of waste ink absorbable by the absorber increases compared to the case where a large amount of waste ink is absorbed for a short period of time. In consideration of such a situation, in the present embodiment, in addition to the first embodiment, the part time count value Cpt is managed by taking ink evaporation into consideration as well.

Figure 13:
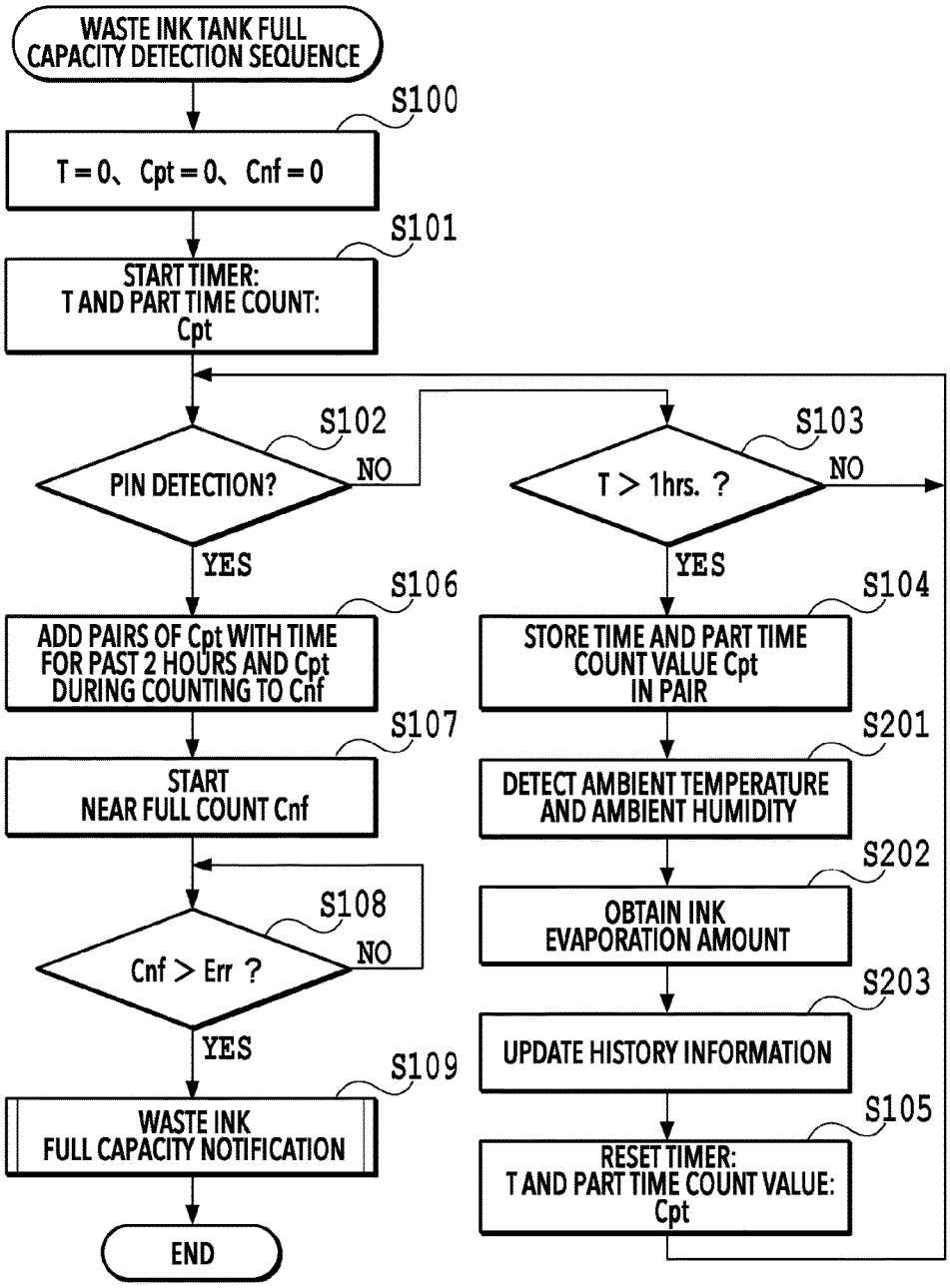
FIG. 13 is a flowchart of a full capacity detection sequence according to a second embodiment.

FIG. 13 is a flowchart illustrating a full capacity detection sequence that the maintenance control unit 210 of the present embodiment performs under instructions from the controller unit 100. A difference from the first embodiment is that step S201 to step S203 are added. Hereinafter, only the processes relating to these steps will be described.

After the count value T is determined to exceed one hour in step S103 and the present part time count value Cpt in association with the present time is stored in the memory in step S104, the process proceeds to step S201. Then, by using a sensor provided in the apparatus, an ambient temperature and an ambient humidity are detected.

In step S202, the maintenance control unit 210 refers to an evaporation amount table stored in advance and obtains an evaporation amount of ink accommodated in the waste ink tank based on the ambient temperature and the ambient humidity detected in step S201.

FIG. 14 is a table which the maintenance control unit 210 refers to in step S202. In this example, an ink evaporation amount corresponding to an ambient temperature and an ambient humidity is stored. For example, in a case where the ambient temperature obtained in step S201 is 25 degrees Celsius and the ambient humidity obtained in step S201 is 60%, an ink evaporation amount is 3 mg.

In step S203, the maintenance control unit 210 corrects the history information stored in the memory. More specifically, the maintenance control unit 210 subtracts the evaporation amount obtained in step S202 from the waste ink amount corresponding to each time and overwrites it with the obtained value.

The processes thereafter are the same as those in the first embodiment. That is, after the timer T and the part time count value Cpt are reset in step S105, the process goes back to step S102 and the maintenance control unit 210 continues the part time count.

According to the above-described present embodiment, full capacity of the ink tank is determined based on not only an amount of waste ink discharged after the point when the detection pin 24 detects ink and an amount of waste ink discharged over the past predetermined period of time before the point when the detection pin 24 detects ink, but also an amount of ink evaporating from the waste ink tank. Therefore, it is possible to more precisely detect full capacity of the waste ink tank.

It should be noted that in the above description, an ink evaporation amount is obtained based on both of the ambient temperature and the ambient humidity. However, the present embodiment is not limited to this. It is possible to more precisely detect full capacity of the waste ink tank as long as the history information is updated based on an ink evaporation amount which is assumed based on at least one of the ambient temperature and the ambient humidity.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-155615 filed Aug. 10, 2017, which is hereby incorporated by reference wherein in its entirety.

What is claimed is:

1. An inkjet printing apparatus comprising:

a print head that ejects ink for printing;

a maintenance unit configured to perform a maintenance operation of the print head;

a waste ink tank having an absorber that absorbs ink discharged by the maintenance unit;

a detecting unit provided on the absorber and configured to detect ink;

a first counting unit configured to count an amount of ink discharged to the waste ink tank for every first period of time;

a second counting unit configured to count an amount of ink discharged to the waste ink tank after the detecting unit detects ink; and a determining unit configured to determine whether an amount of ink in the waste ink tank is equal to or greater than a predetermined amount, wherein the determining unit makes determination based on an amount of ink counted by the first counting unit over a past second period of time before a point when the detecting unit detects ink and an amount of ink counted by the second counting unit.

2. The inkjet printing apparatus according to claim 1, wherein the determining unit determines that an amount of ink in the waste ink tank is equal to or greater than the predetermined amount in a case where a sum of an amount of ink counted by the first counting unit over the past second period of time before a point when the detecting unit detects ink and an amount of ink counted by the second counting unit exceeds a predetermined threshold.

3. The inkjet printing apparatus according to claim 1, wherein the second period of time is a time required for permeation of ink discharged in the maintenance operation to stop in the absorber after the maintenance operation is started.

4. The inkjet printing apparatus according to claim 1, wherein the first period of time is shorter than the second period of time.

5. The inkjet printing apparatus according to claim 1, wherein the first counting unit counts an amount of ink discharged to the waste ink tank by referring to a table in which a type of maintenance operation and an amount of discharged ink are associated with each other and stored in advance.

6. The inkjet printing apparatus according to claim 1, further comprising a memory for storing a result of counting by the first counting unit as history information corresponding to a time.

7. The inkjet printing apparatus according to claim 6, wherein the memory stores the history information for a past third period of time before a present time, the third period of time being greater than the second period of time.

8. The inkjet printing apparatus according to claim 6, wherein the determining unit corrects the history information based on an ink evaporation amount in the waste ink tank corresponding to at least one of an ambient temperature and an ambient humidity.

9. The inkjet printing apparatus according to claim 1, wherein the maintenance operation includes suction operation for sucking ink from an ejection opening of the print head.

10. The inkjet printing apparatus according to claim 1, wherein the maintenance operation includes a preliminary ejection operation from the print head.

11. The inkjet printing apparatus according to claim 1, further comprising a notifying unit configured, in a case where the determining unit determines that an amount of ink in the waste ink tank is equal to or greater than the predetermined amount, to notify a user of the determination.

12. A detecting method for detecting ink in a waste ink tank of an inkjet printing apparatus that includes:

a print head that ejects ink for printing;

a maintenance unit configured to perform a maintenance operation of the print head;

a waste ink tank having an absorber that absorbs ink discharged by the maintenance unit; and a detecting unit provided on the absorber and configured to detect ink discharged to the absorber, the detecting method comprising:

a first counting step of counting an amount of ink discharged to the waste ink tank for every first period of time;

a second counting step of counting an amount of ink discharged to the waste ink tank after the detecting unit detects ink; and a determining step of determining whether an amount of ink in the waste ink tank is equal to or greater than a predetermined amount based on an amount of ink counted in the first counting step over a past second period of time before a point when the detecting unit detects ink and an amount of ink counted in the second counting step.

* * * * *